United States Patent [19]

Sujaku

[11] Patent Number: 4,577,079

[45] Date of Patent: Mar. 18, 1986

[54] DOOR OF MICROWAVE OVEN

[75] Inventor: Takamichi Sujaku, Nagoya, Japan

[73] Assignee: Kabushiki Kaisha Toshiba, Kawasaki, Japan

[21] Appl. No.: 726,993

[22] Filed: Apr. 25, 1985

[30] Foreign Application Priority Data

May 22, 1984 [JP] Japan ..... 59-74747[U]

[51] Int. Cl.[4] ..... H05B 6/76

[52] U.S. Cl. ..... 219/10.55 D; 219/10.55 R; 219/522; 126/198; 126/200

[58] Field of Search ..... 219/10.55 D, 10.55 R, 219/522; 126/190, 198, 200; 52/304, 789, 790, 822, 823, 829, 830

[56] References Cited

U.S. PATENT DOCUMENTS

| | | | |
|---|---|---|---|
| 4,051,341 | 9/1977 | Tanaka et al. | 219/10.55 D |
| 4,206,338 | 6/1980 | Katona | 126/200 X |
| 4,264,800 | 4/1981 | Jahnke et al. | 219/10.55 D |

*Primary Examiner*—Philip H. Leung

*Attorney, Agent, or Firm*—Schwartz, Jeffery, Schwaab, Mack, Blumenthal & Evans

[57] ABSTRACT

A door of a microwave oven comprises a frame-like door plate having a central window, upper and lower sashes secured to the door plate, a screen to cover the central window, outer and inner barriers for protecting the screen, and a contact plate to be brought into contact with a peripheral portion of the oven. A door cover made of a heat-resistant material is provided around the contact plate and engageable portions are provided for securing the door cover in its position without utilizing machine screws and the like.

7 Claims, 9 Drawing Figures

DOOR OF MICROWAVE OVEN

BACKGROUND OF THE INVENTION

This invention relates to a door of a microwave oven of the type in which a door cover, made of a heat-resistant material, is provided around a peripheral portion thereof.

Ordinarily, a microwave oven comprises a cabinet, a heating and cooking chamber provided with an access opening, a door for closing and opening the access opening, and a high frequency oscillator for radiating a high frequency electromagnetic wave in to the heating chamber. A control panel having control switches and the like is provided in a front part of the cabinet adjacent to the door.

The door of the microwave oven comprises a door plate of a frame-like configuration having a central window, upper and lower sashes secured to the upper and lower edges of the door plate, a perforated screen provided to cover the central window of the door plate, outer and inner barriers made of a transparent material provided on the front side and the rear side of the screen, respectively, a contact plate formed integrally with the screen to be brought into contact with the cabinet, and a door cover which is provided to cover a gap formed between the contact plate and the peripheral edges of the door. Because of high heat-insulating requirement, the door cover is ordinarily made of a synthetic resin mixed with glass fibers and is ordinarily secured to the door plate by means of machine screws and the like. The use of machine screws and the like, however, entails disadvantages of increasing the number of parts required, increasing time and labor required for the assembling, and hence increasing the production cost.

SUMMARY OF THE INVENTION

An object of this invention is to provide a door of a microwave oven wherein the above described difficulties of the conventional construction can be substantially eliminated.

Another object of this invention is to provide a door of a microwave oven wherein the door cover is provided with engaging portions and held in its position by simply engaging the engaging portions with a related member.

These and other objects of the present invention can be achieved by providing a door for a microwave oven, disposed forward of an access opening formed in a cabinet of the oven, for opening and closing the access opening. The door comprises a door plate of a frame-like construction having a central window, upper and lower sashes secured to the door plate so as to cover upper and lower ends of the door plate, an outer barrier provided forwardly of the door plate to cover the central window, a screen having a number of perforations provided to cover the central window on the rear side thereof, a contact plate formed integrally with the screen to surround the same so that the contact plate is contactable with the cabinet at a portion surrounding the access opening, an inner barrier provided in contact with a rear side of the screen, a door cover engageable with the upper and lower sashes and the contact plate and having an opening at the center. The upper and lower sashes have rearward edges bent inwardly to hold the door cover. The contact plate has outer peripheral portions first bent forwardly and then bent outwardly thereby forming stepped portions for supporting the door cover. The door further comprises at least a pair of engaging portions provided along an internal edge of the door cover to be brought into engagement with mating portions of the contact plate.

DESCRIPTION OF THE PREFERRED EMBODIMENTS

Figure 1:
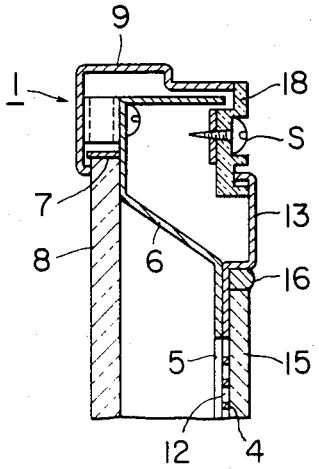
FIG. 1 PRIOR ART
FIG. 1 is an elevational view in section showing one part of a conventional construction of a door used for a microwave oven.

Before entering description of the present invention, a conventional construction of a door used for opening and closing a microwave oven will be described in detail with reference to FIG. 1.

A door 1 of the microwave oven provided in front of of an access opening of a cooking chamber formed in a cabinet, not shown. The door 1 comprises a door plate 6 made of a zinc-plated metal plate formed into a substantially rectangular frame-like configuration having a window 5 at the center. An upper sash 9 and a lower sash, not shown, also made of a zinc-plated metal plate, are secured to the upper and lower ends of the door plate 6. On the front side (away from the cabinet) of the door plate 6 is provided an outer barrier 8 made of a transparent, heat-resistant glass plate, which is held between the sashes and the door plate at a position defined by stoppers 7 rising-up from the peripheral portion of the door plate 6. A screen 4 and a contact plate 13 formed integrally into a single member 3 are provided on the rear side of the door plate 6 and secured to the door plate 6 by welding means and the like. An inner barrier 15 also made of a transparent heat-resistant glass plate is bonded to the rear side of the screen 4 by use of a bonding agent 16. A door cover 18 surrounding the contact plate 13 is also secured to the door plate 6 by means of machine screws S and the like.

The conventional construction of a door for a microwave oven, however, has revealed difficulties as described hereinbefore, and improvement thereof has been urgently required.

A door of a microwave oven according to this invention will now be described with reference to FIGS. 2 through 9 in which similar members as those shown in FIG. 1 are designated by similar reference numerals.

Figure 2:
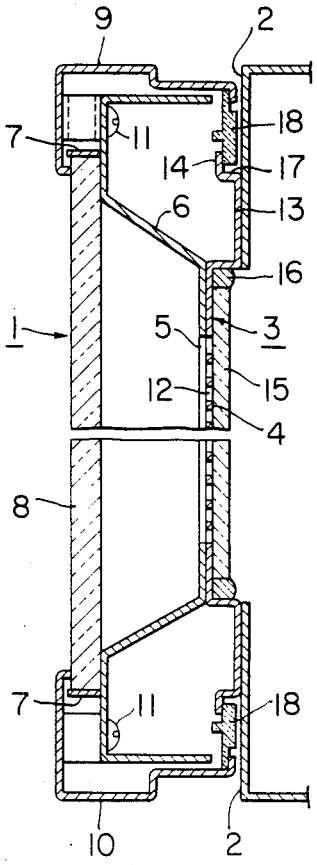
FIG. 2 is an elevational view in section showing a preferred embodiment of the present invention.
Figure 3:
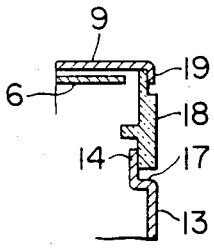
FIGS. 3 and 4 are enlarged sectional views showing upper and lower end portions adjacent to a cabinet, of the embodiment shown in FIG. 2.
Figure 4:
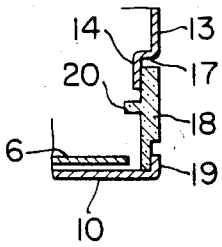
Figure 5:
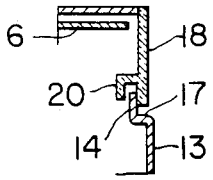
FIG. 5 is a sectional view taken along a horizontal line showing one part of the embodiment shown in FIG. 2.
Figure 6:
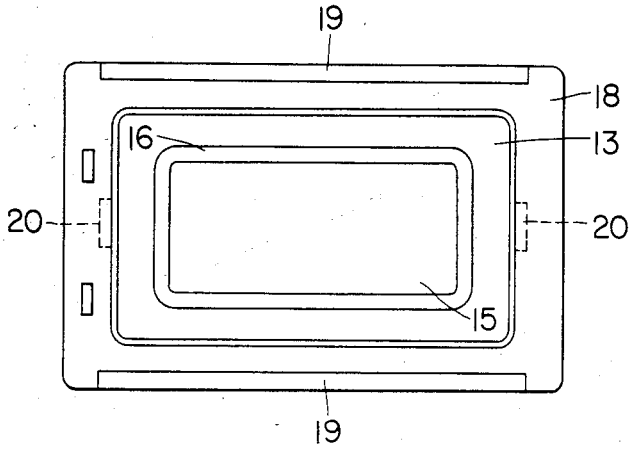
FIG. 6 is a rear side view of the embodiment shown in FIG. 2.

Referring first to FIG. 2 showing a preferred embodiment of the present invention, the door 1 comprises a door plate 6 made of a zinc-plated metal plate formed into a substantially rectangular frame-like configuration having a substantially rectangular window 5 at a central portion thereof. Stoppers 7 are formed at a plurality of positions spaced apart from each other along the forward surface of the door plate 6 surrounding the window 5 by partly slitting and bending the portions of the door plate perpendicularly upward. An outer barrier 8 is provided on the front side of the door plate 6 at a position defined by the stoppers 7. Upper and lower sashes 9 and 10 made of a zinc-plated metal plate, each being formed into an L-shaped cross-section, are secured to the forward upper and lower portions of the door plate 6 by means of machine screws 11, so that the sashes cover upper and lower ends of the door plate 6, respectively. By tightening the machine screws 11, the upper and lower edges of the outer barrier 8 are clamped and secured between the upper and lower sashes 9 and 10 and the front surface of the door plate 6. The outer barrier 8 is made of a transparent heat-resistant glass and provided for protecting a screen as described hereafter. A suitable pattern may be printed on the surface of the outer barrier 8 for improving aesthetical feature of the microwave oven.

On the rear side of the door plate 6, a screen member 3 made of, for instance, a zinc-plated metal plate is provided secured to the door plate 6 by means of welding or the like. The screen member 3 comprises a screen 4 and a contact plate 13 formed integrally. A number of perforations 12 are provided through the screen 4 for permitting observation of the interior of the cooking chamber in the cabinet therethrough. The contact plate 13 provided surrounding the screen 4 has an internal edge portion adjacent to the screen 4 bent to project rearwardly thereby to provide a surface portion to be brought into contact with an oven plate 2 of the cabinet when the door of the microwave oven is closed. The contact plate 13 has an outer periphery extending forwardly and then outwardly thereby forming a stepped portion. On the rear side of the screen 4 is provided an inner barrier 15 made of a transparent, heat-resistant glass, which is secured to the screen 4 by means of a bonding and sealing agent 16 such as a silicone resin. The inner barrier 15 serves to protect the screen 4 from steam and oil vapor generated in the cooking chamber and to prevent dirt from intruding into the perforations 12 and depositing on the rear-side surface of the outer barrier 8.

Outwardly of the contact plate 13, there is provided a door cover 18 having a central opening 17. The door cover 18 is held in its position with the internal edge surrounding the central opening 17 placed to abut against the stepped portion formed outwardly of the contact plate 13. In this embodiment, the rearward edges of the upper and lower sashes 9 and 10 are entirely bent inwardly, as shown in FIGS. 3 through 6, so as to provide engaging portions 19. Furthermore, on the right side and left side of the door cover 18 as viewed in FIG. 6, engaging projections 20 of an L-shape and of a predetermined length are provided to project inwardly and forwardly from the internal edge of the door cover 18.

The door cover 18 is secured in its position as follows 1;

Firstly, the upper edge of the door cover 18 is inserted into engagement with the engaging portion 19 of the upper sash 9. Then, the lower edge of the door cover 18 is inserted into engagement with the engaging portion 19 of the lower sash 10 while the entire portion of the door cover 18 is flexed forwardly. Then, the engaging portions 20 of the door cover 18 are brought into engagement with the corresponding edge portions of the contact plate 13 while the right and left side portions of the door cover 18 are firstly pushed outwardly and then twisted forwardly. In this manner, the door cover 18 is secured in its position without utilizing the machine screws and the like. When the door cover 18 is secured as described above, the internal edge of the door cover 18 is held on the stepped portion formed in the peripheral portion of the contact plate 13, and no recognizable gap is formed between the internal edge of the door cover 18 and the stepped portion of the contact plate 13.

Figure 7:
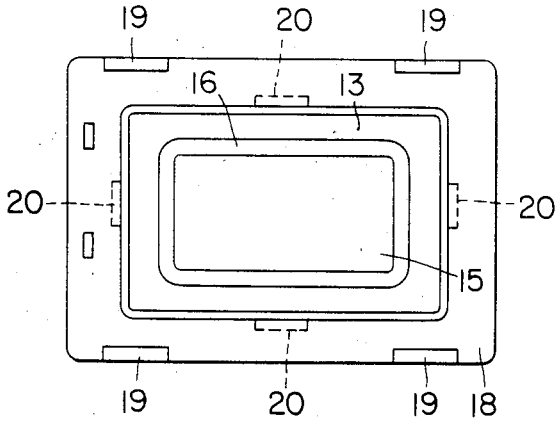
FIG. 7 is a rear side view showing a modification of the embodiment.

Although the invention has been described with respect to a preferred embodiment thereof, it is apparent that the invention may otherwise be constructed as shown in FIG. 7. The engaging portions 19 formed at the rear ends of the upper and lower sashes 9 and 10 are provided partially, while the engaging portions 20 formed along the internal edge surrounding the central opening 17 are provided not only on the right and left sides, but also on the upper and lower sides of the door cover 18. In this case also the door cover 18 can be secured in its position without utilizing the machine screws and the like.

Figure 8:
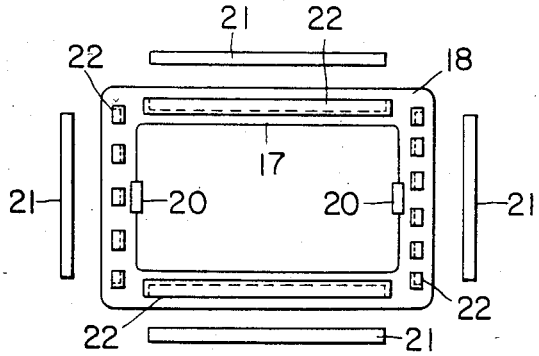
FIG. 8 is a rear side diagram showing another embodiment of the invention.
Figure 9:
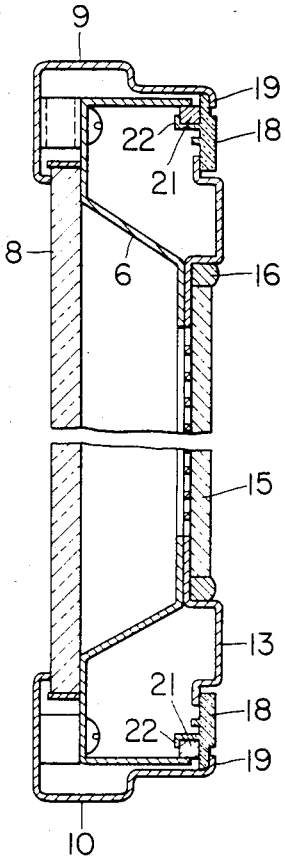
FIG. 9 is a side elevational view in section of the embodiment shown in FIG. 8.

FIGS. 8 and 9 illustrate a modification of the described hereinabove wherein ferrite bars 21 are provided around the door cover 18 for preventing leakage of microwaves. In this embodiment, supporting members 22 for the ferrite bars 21 formed into an L-shaped cross-section are provided on the front side of the door cover 18. Some of the supporting members 22 for the ferrite bars 21 provided along the upper and lower side portions of the door cover 18 are extended substantially along the entire lengths of the upper and lower side portions of the door cover. A plurality of short ferrite bar supporting members 22 are provided in a spaced apart relation along the right and left side portions of the door cover 18. In this modification, the ferrite bars 21 are firstly placed on the ferrite bar supporting member 22, and then door cover 18 is secured to its position by means of the engaging portions 19 of the upper and lower sashes 9 and 10 and the engaging portions 20 formed on the door cover 18.

Since the ferrite bar supporting members 22 on the right and left side portions of the door cover 18 are arranged in an interrupted manner, the door cover 18 can be bent as desired when the door cover 18 is secured in its position.

In this embodiment, the vertical measurement of the engaging portion 19 of the upper sash 9 is made larger than that of the engaging portion 19 of the lower sash 10. As a consequence, even in a case where the door cover 18 is deformed to be bent downwardly by the weight of the ferrite bar 21, there is no possibility of the upper edge of the door cover 18 for being disengaged from the engaging portion 19 of the upper sash 9.

The engagement of the door cover 18 may be effectuated along both side edge portions of the door cover 18 instead of the above described upper and lower edges thereof. In this case, the measurements of the engaging portion on the side having a door handle, where the impact at the time of opening and closing the door is large, are selected to be larger than those on the other side of the door.

According to this invention, engaging portions are provided at the rear edges of the upper and lower sashes and also at required positions of the door cover, and the door cover is secured in its position by inserting the upper and lower edges of the door cover into the engaging portions of the upper and lower sashes and also by bringing the engaging portions of door cover into engagement with the peripheral portions of the contact plate made integrally with the screen availing the bendability of the door cover, the door cover can be secured without requiring the machine screws and the like, thus simplifying the assembling operation of the oven door.

Furthermore, since local bending of the door cover is not utilized, the door cover may be made of a comparatively fragile heat-resistant resin without imposing any problem.

What is claimed is:

1. A door for a microwave oven for opening and closing an access opening formed in a cabinet, said door comprising:

a door plate of a frame-like construction having a central window and having a forward side facing away from the opening and an inward side facing the opening;

upper and lower sashes secured to said door plate so as to cover upper and lower ends of said door plate;

an outer barrier provided on the forward side of the door plate and arranged to cover said central window;

a screen having a front and a rear side and a number of perforations, the front side of said screen facing and covering the inward side of said central window;

a contact plate formed integrally with said screen to surround the same so that said contact plate is contactable with said cabinet at a portion surrounding said access opening, an inner barrier provided in contact with the rear side of said screen;

a door cover engageable with said upper and lower sashes and with said contact plate and having an opening at the center;

said upper and lower sashes having at least a portion of their rearward edges which face the cabinet bent radially inwardly toward the central portion of the door to hold said door cover;

said contact plate having outer peripheral portions firstly bent toward the forward side and then bent radially outwardly thereby forming stepped portions for supporting said door cover; and at least one pair of engaging portions provided along an internal edge of said door cover to be brought into engagement with said stepped portions of said contact plate.

2. A door according to claim 1 wherein said door cover is made of a synthetic resin mixed with glass fibers.

3. A door according to claim 1 wherein said at least one pair of engaging portions of said door cover have an L-shaped cross section, so that the engaging portions are engageable with outer peripheral portions of said contact plate.

4. A door according to claim 1 wherein said at least one pair of engaging portions of said door cover are provided at right and left positions which are symmetrical with each other with respect to the central opening of said door cover.

5. A door according to claim 1 wherein said engaging portions of said door cover are provided at upper and lower positions which are symmetrical with each other with respect to the central opening of said door cover.

6. A door according to claim 1 wherein said engaging portions of said door cover are provided at right and left positions and upper and lower positions which are symmetrical with each other with respect to the central opening of said door cover.

7. A door according to claim 1 wherein substantially the entire length of said rearward edges of said upper and lower sashes facing said cabinet of the oven is bent radially inwardly toward a central portion of the door.

* * * * *